US011539169B2

(12) United States Patent
Hsiao et al.

(10) Patent No.: US 11,539,169 B2
(45) Date of Patent: Dec. 27, 2022

(54) ELECTRICAL CONNECTOR

(71) Applicants: FU DING PRECISION INDUSTRIAL (ZHENGZHOU) CO., LTD., Zhengzhou (CN); FOXCONN INTERCONNECT TECHNOLOGY LIMITED, Grand Cayman (KY)

(72) Inventors: Shih-Wei Hsiao, New Taipei (TW); Yu-San Hsiao, New Taipei (TW); Yen-Chih Chang, New Taipei (TW); Meng Liu, Kunshan (CN); Zhan-Sheng Meng, Kunshan (CN)

(73) Assignees: FUDING PRECISION INDUSTRY (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/137,397

(22) Filed: Dec. 30, 2020

(65) Prior Publication Data

US 2021/0203106 A1 Jul. 1, 2021

(30) Foreign Application Priority Data

Dec. 31, 2019 (CN) ..... 201911405634.4

(51) Int. Cl.
*H01R 4/66* (2006.01)
*H01R 13/6471* (2011.01)
(Continued)

(52) U.S. Cl.
CPC ..... *H01R 13/6471* (2013.01); *H01R 12/55* (2013.01); *H01R 12/716* (2013.01);
(Continued)

(58) Field of Classification Search
CPC .. H01R 12/55; H01R 12/716; H01R 13/6471; H01R 13/6587; H01R 13/6473; H01R 13/514
(Continued)

(56) References Cited

U.S. PATENT DOCUMENTS 5,201,855 A 4/1993 Ikola
6,899,566 B2 5/2005 Kline et al.
(Continued)

FOREIGN PATENT DOCUMENTS

CN 101159354 A 4/2008
CN 101981764 A 2/2011
(Continued)

*Primary Examiner* — Khiem M Nguyen
(74) *Attorney, Agent, or Firm* — Ming Chieh Chang

(57) ABSTRACT

An electrical connector includes: plural terminal modules stacked laterally, each of the terminal modules including an insulating body, plural pairs of signal terminals held by the insulating body, plural ground terminals held by the insulating body, and a first ground plate and a second ground plate located on opposite sides of the insulating body, wherein: in each terminal module, the ground terminals and the pairs of signal terminals are alternately arranged in a vertical direction, each pair of signal terminals are arranged in a first plane, each ground terminal is arranged in a second plane intersecting the first plane, the first ground plate, the second ground plate, and the ground terminals shield each pair of signal terminals circumferentially.

20 Claims, 18 Drawing Sheets

(51) Int. Cl.

| | |
|---|---|
| ***H01R 13/6587*** | (2011.01) |
| ***H01R 12/55*** | (2011.01) |
| ***H01R 13/514*** | (2006.01) |
| ***H01R 12/71*** | (2011.01) |
| *H01R 13/6473* | (2011.01) |

(52) U.S. Cl.
CPC ..... *H01R 13/514* (2013.01); *H01R 13/6587* (2013.01); *H01R 13/6473* (2013.01)

(58) Field of Classification Search
USPC ..... 439/92, 108
See application file for complete search history.

(56) References Cited

U.S. PATENT DOCUMENTS

| | | | |
|---|---|---|---|
| 6,988,902 | B2 | 1/2006 | Winings et al. |
| 7,785,148 | B2 | 8/2010 | Pan |
| 8,202,118 | B2 | 6/2012 | Cohen et al. |
| 8,465,302 | B2 | 6/2013 | Regnier et al. |
| 8,715,005 | B2 | 5/2014 | Pan |
| 8,905,786 | B2 | 12/2014 | Davis et al. |
| 8,920,195 | B2 | 12/2014 | Cohen et al. |
| 8,961,227 | B2 | 2/2015 | Gailus et al. |
| 8,961,229 | B2 | 2/2015 | Pan |
| 9,077,094 | B2 | 7/2015 | Minich |
| 9,356,401 | B1 | 5/2016 | Horning et al. |
| 9,407,045 | B2 | 8/2016 | Horning et al. |
| 9,748,698 | B1 | 8/2017 | Morgan et al. |
| 9,831,588 | B2 | 11/2017 | Cohen |
| 9,843,119 | B1 | 12/2017 | Chen |
| 10,038,282 | B2 | 7/2018 | De Geest et al. |
| 10,170,869 | B2 | 1/2019 | Gailus et al. |
| 10,205,286 | B2 | 2/2019 | Provencher et al. |
| 10,355,416 | B1 | 7/2019 | Pickel et al. |
| 10,644,453 | B2 | 5/2020 | Laurx et al. |
| 10,686,282 | B1 | 6/2020 | McCarthy et al. |
| 10,707,626 | B2 | 7/2020 | Cartier, Jr. et al. |
| 2001/0046810 | A1 | 11/2001 | Cohen |
| 2002/0048995 | A1 | 4/2002 | Shindo |
| 2004/0043661 | A1 | 3/2004 | Okada et al. |
| 2005/0215120 | A1 | 9/2005 | Tokunaga |
| 2005/0215121 | A1 | 9/2005 | Tokunaga |
| 2009/0203259 | A1 | 8/2009 | Nguyen |
| 2011/0034075 | A1 | 2/2011 | Feldman et al. |
| 2012/0196482 | A1 | 8/2012 | Stokoe |
| 2012/0238148 | A1 | 9/2012 | Lee et al. |
| 2013/0217263 | A1 | 8/2013 | Pan |
| 2013/0316594 | A1 | 11/2013 | Stokoe |
| 2017/0310032 | A1 | 10/2017 | Sasaki et al. |
| 2017/0373439 | A1 | 12/2017 | Wen et al. |
| 2019/0237910 | A1 | 8/2019 | Chalas et al. |

FOREIGN PATENT DOCUMENTS

| | | | |
|---|---|---|---|
| CN | 102106043 | A | 6/2011 |
| CN | 202034538 | | 11/2011 |
| CN | 202454772 | | 9/2012 |
| CN | 103296510 | A | 9/2013 |
| CN | 203553506 | U | 4/2014 |
| CN | 104022402 | A | 9/2014 |
| CN | 104347988 | A | 2/2015 |
| CN | 204304028 | U | 4/2015 |
| CN | 204333356 | U | 5/2015 |
| CN | 204668627 | | 9/2015 |
| CN | 105470732 | A | 4/2016 |
| CN | 105470736 | A | 4/2016 |
| CN | 102904119 | | 6/2016 |
| CN | 102738621 | A | 8/2016 |
| CN | 105977665 | A | 9/2016 |
| CN | 104167620 | | 8/2017 |
| CN | 107408769 | A | 11/2017 |
| CN | 104718666 | | 8/2018 |
| CN | 108631094 | U | 10/2018 |
| CN | 109273932 | A | 1/2019 |
| CN | 109494499 | | 3/2019 |
| CN | 109546384 | A | 3/2019 |
| CN | 109599726 | A | 4/2019 |
| CN | 209029559 | U | 6/2019 |
| CN | 109980386 | A | 7/2019 |
| CN | 105470736 | | 8/2019 |
| CN | 110299649 | A | 10/2019 |
| CN | 209709299 | U | 11/2019 |
| CN | 209843999 | U | 12/2019 |
| JP | 2002042978 | A | 2/2002 |

ELECTRICAL CONNECTOR

BACKGROUND OF THE INVENTION

1. Field of the Invention

The present invention relates generally to an electrical connector and electrical connector assembly, and more particularly to a high-speed backplane electrical connector with a ground shield.

2. Description of Related Arts

China Patent No. 204668627 discloses an electrical connector including a plurality of terminal modules. Each terminal module includes an insulating body and a signal terminal held in the insulating body, a grounding terminal held in the insulating body, and a grounding plate on one side of the insulating body. The ground terminal and the signal terminal are arranged in same plane and there is only one ground plate such that the signal terminal is not shielded from a circumferential direction.

China Patent No. 102904119 discloses an electrical connector assembly includes electrical connector and mating connector. The electrical connector includes a signal terminal and a ground sheet shielding the signal terminal. The mating connector includes a plurality of laterally arranged terminal modules. Each terminal module includes a first ground plate on a first side of the terminal module and a second ground plate on a second side opposite to the first side. The ground sheet is only mechanically and electrically connected to the ground plate of one terminal module, such that adjacent terminal modules may have crosstalk problems and the shielding effect is not ideal. Therefore, an improved electrical connector and electrical connector assembly is needed.

An improved electrical connector assembly that has good grounding shielding effect is desired.

SUMMARY OF THE INVENTION

A main object of the present invention is to provide an electrical connector with good grounding effect.

To achieve the above-mentioned object, an electrical connector comprises: a plurality of terminal modules stacked laterally, each of the terminal modules including an insulating body, plural pairs of signal terminals held by the insulating body, a plurality of ground terminals held by the insulating body, and a first ground plate and a second ground plate located on opposite sides of the insulating body, wherein: in each terminal module, the ground terminals and the pairs of signal terminals are alternately arranged in a vertical direction, each pair of signal terminals are arranged in a first plane, each ground terminal is arranged in a second plane intersecting the first plane, the first ground plate, the second ground plate, and the ground terminals shield each pair of signal terminals circumferentially.

To achieve the above-mentioned object, an electrical connector assembly comprises: an electrical connector comprising a plurality of first ground sheets arranged laterally; and a mating connector cooperating with the electrical connector and comprising a plurality of terminal modules laterally arranged, each terminal module including a first ground plate on a first side of the terminal module and a second ground plate on an opposite second side of the terminal module, wherein the first ground sheet is mechanically and electrically connected to the first ground plate and the second ground plate at adjacent sides of two adjacent terminal modules.

Compared to the prior art, in the electrical connector of the present invention, the ground terminal is arranged in a plane intersecting a plane where the signal terminals are arranged, the first ground plate, the second ground plate, and the ground terminal cooperate to completely shield a pair of signal terminals along an entire transmission path in a circumferential direction, and the ground sheet of the electrical connector of the electrical connector assembly of the present invention is mechanically and electrically connected to the ground plate of the adjacent terminal module of the mating connector, thereby improving the shielding effect between adjacent terminal modules and providing better conditions for stable transmission of high-frequency signals.

DETAILED DESCRIPTION OF THE PREFERRED EMBODIMENT

Figure 1:
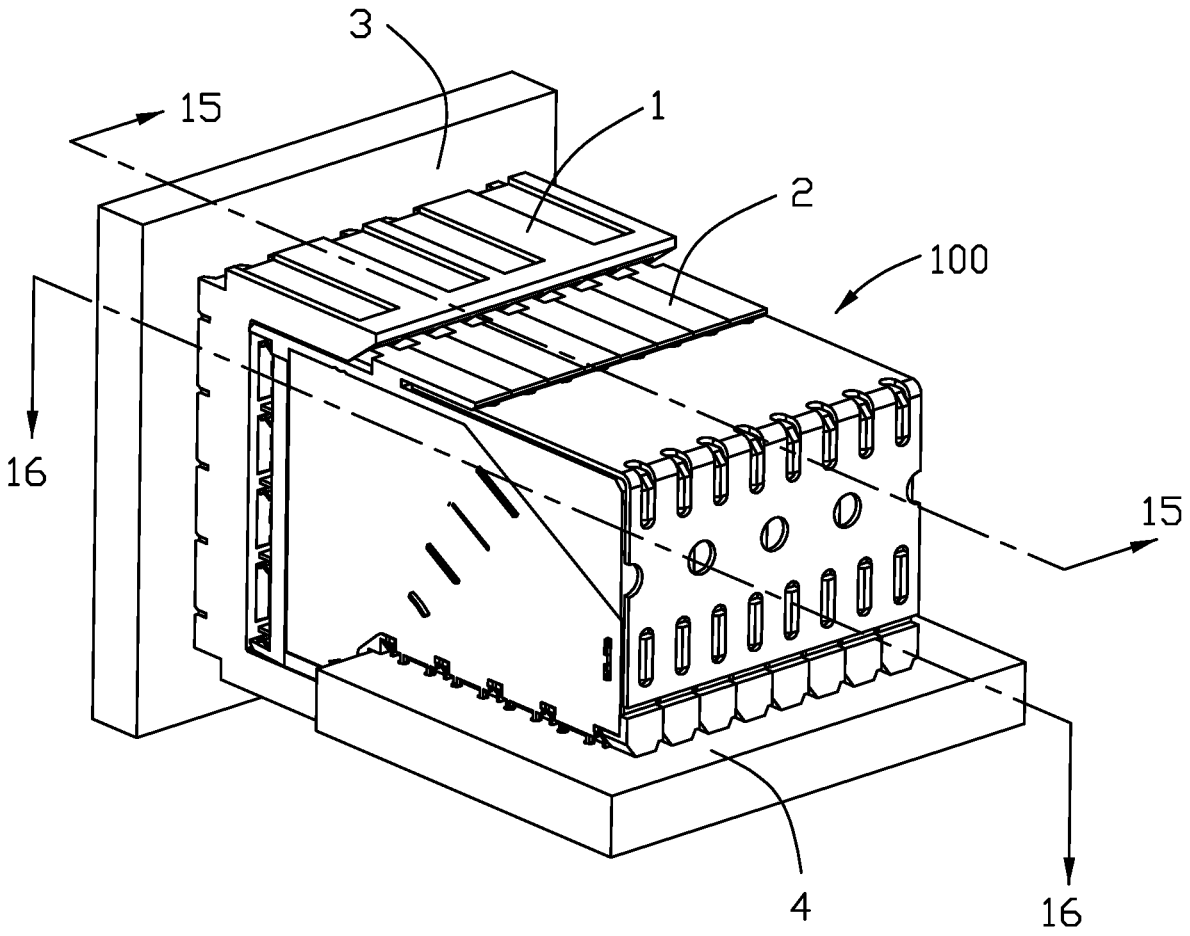
FIG. 1 is a perspective view of the first electrical connector and the second electrical connector of the connector assembly in accordance with the present invention after mating.
Figure 2:
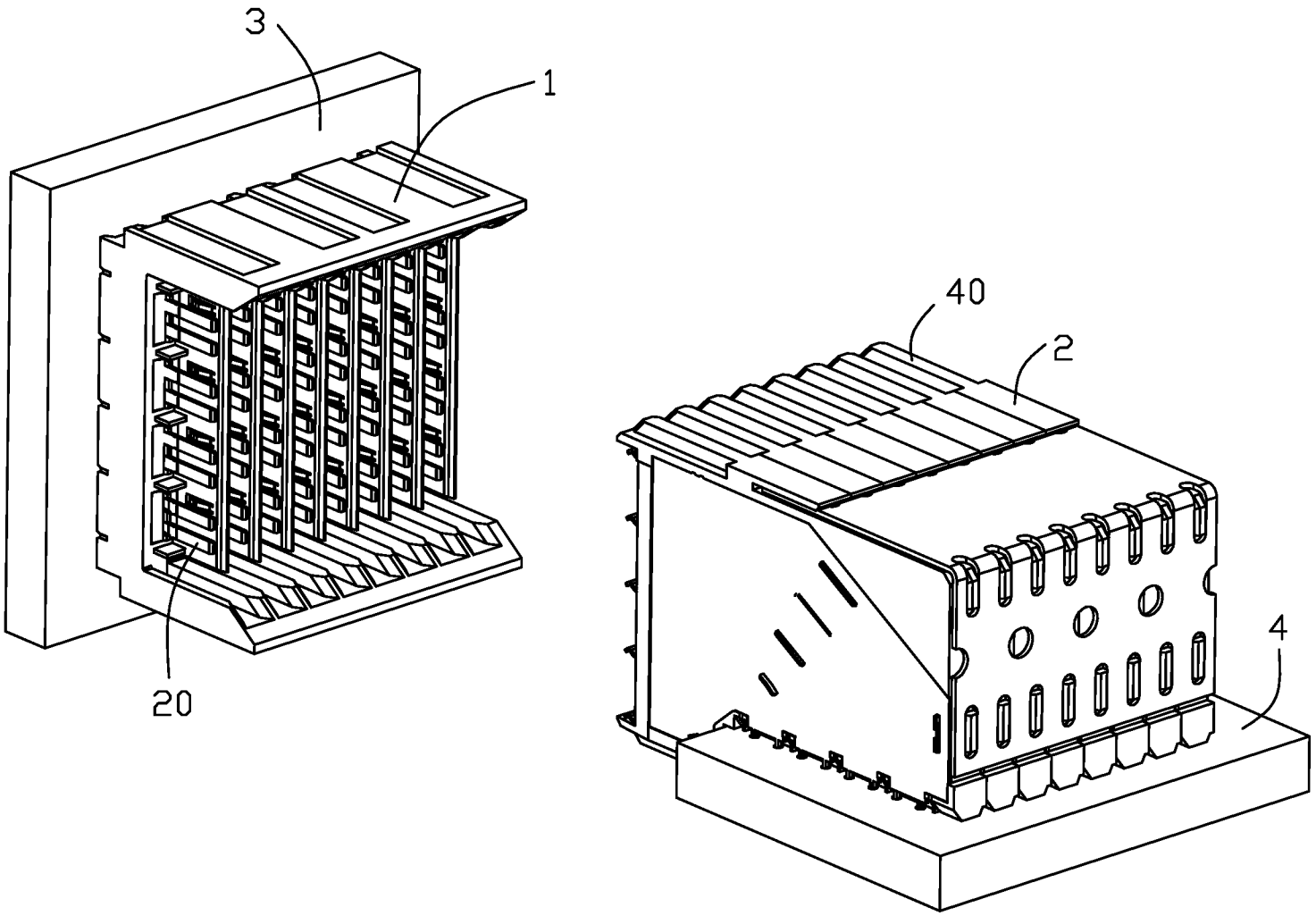
FIG. 2 is a perspective view of the connector assembly before mating in FIG. 1.
Figure 3:
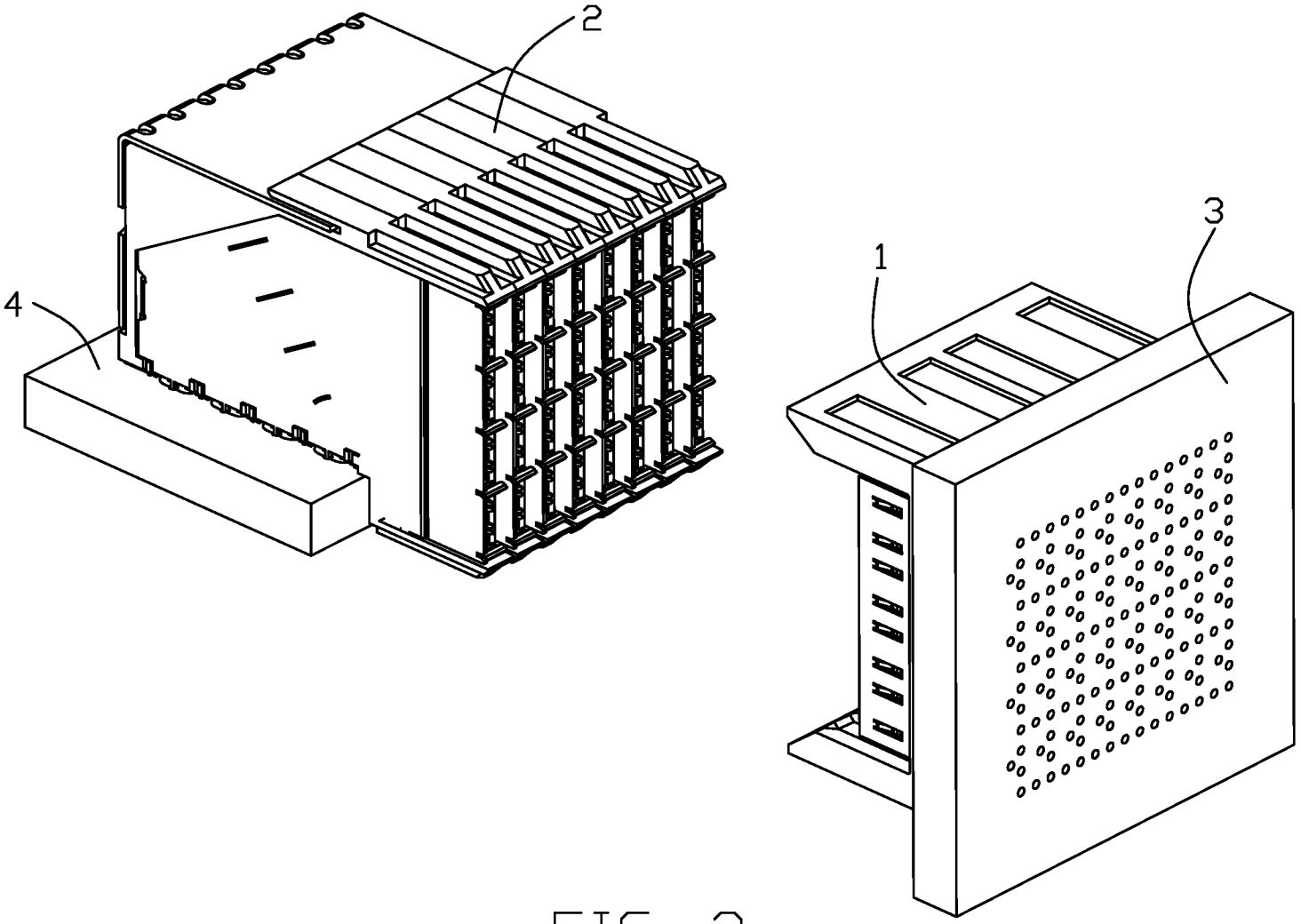
FIG. 3 is another perspective view of the connector assembly in FIG. 2.
Figure 4:
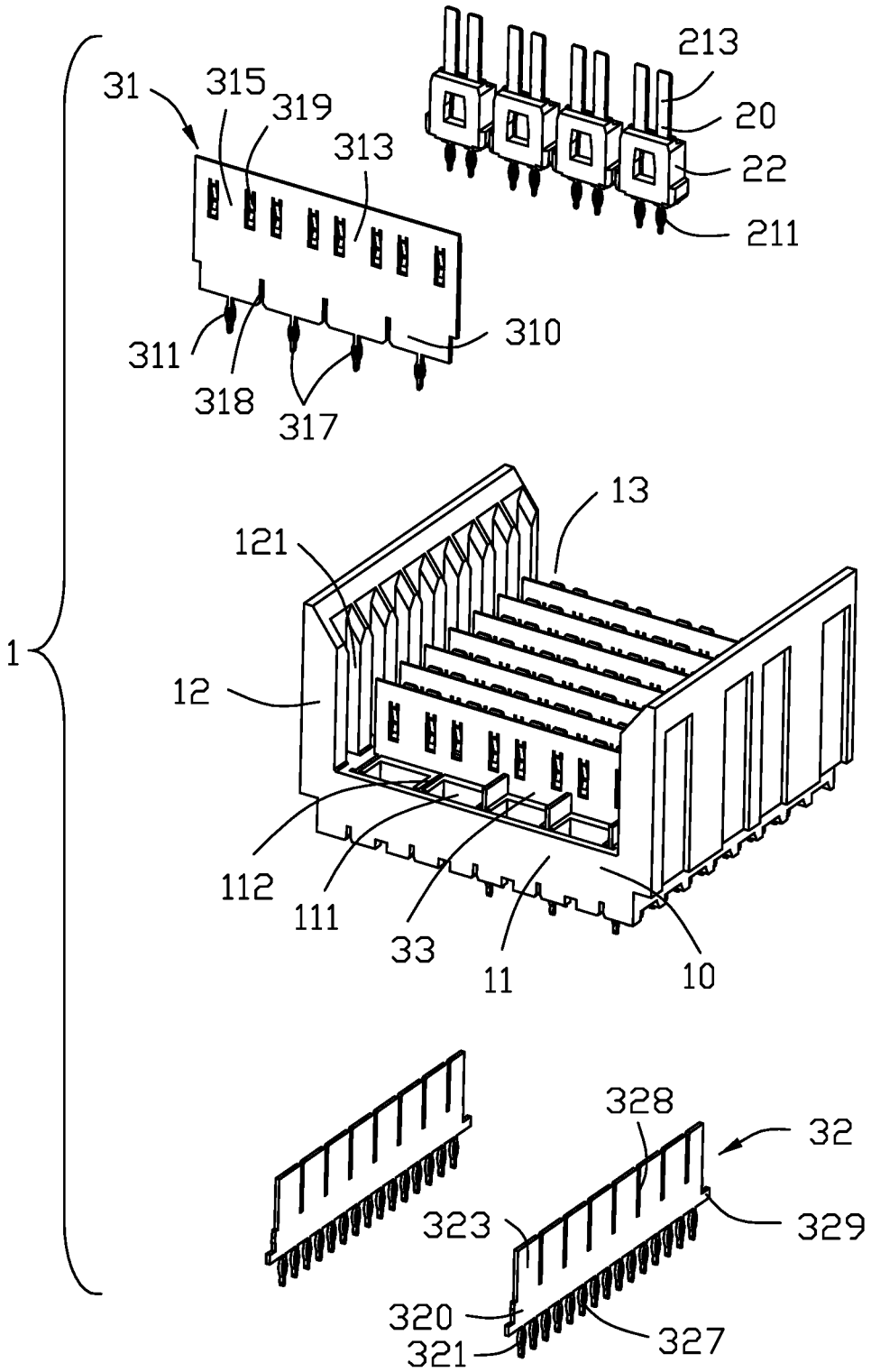
FIG. 4 is a partial exploded view of the first electrical connector in FIG. 1.
Figure 5:
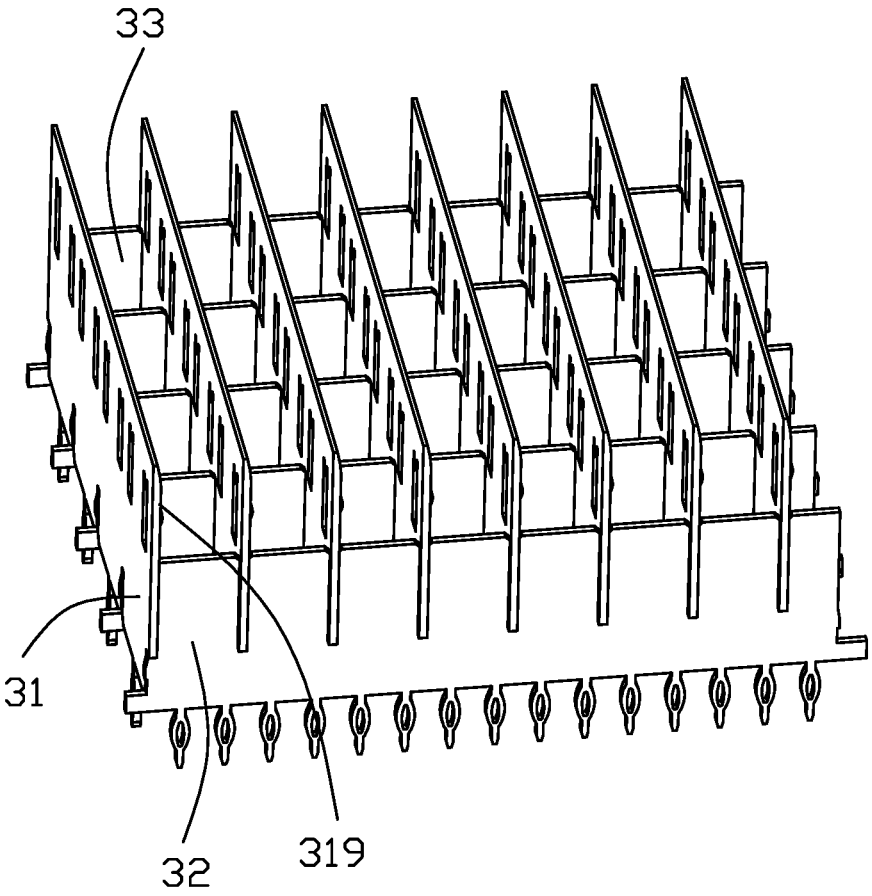
FIG. 5 is the first grounding sheet and the second grounding sheet of the first electrical connector in FIG. 4.
Figure 6:
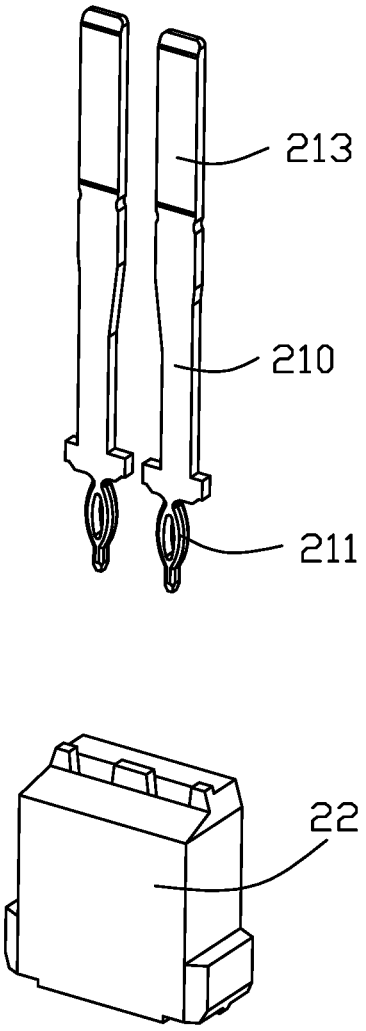
FIG. 6 is a partial exploded view of terminal assembly of the first electrical connector in FIG. 4.
Figure 7:
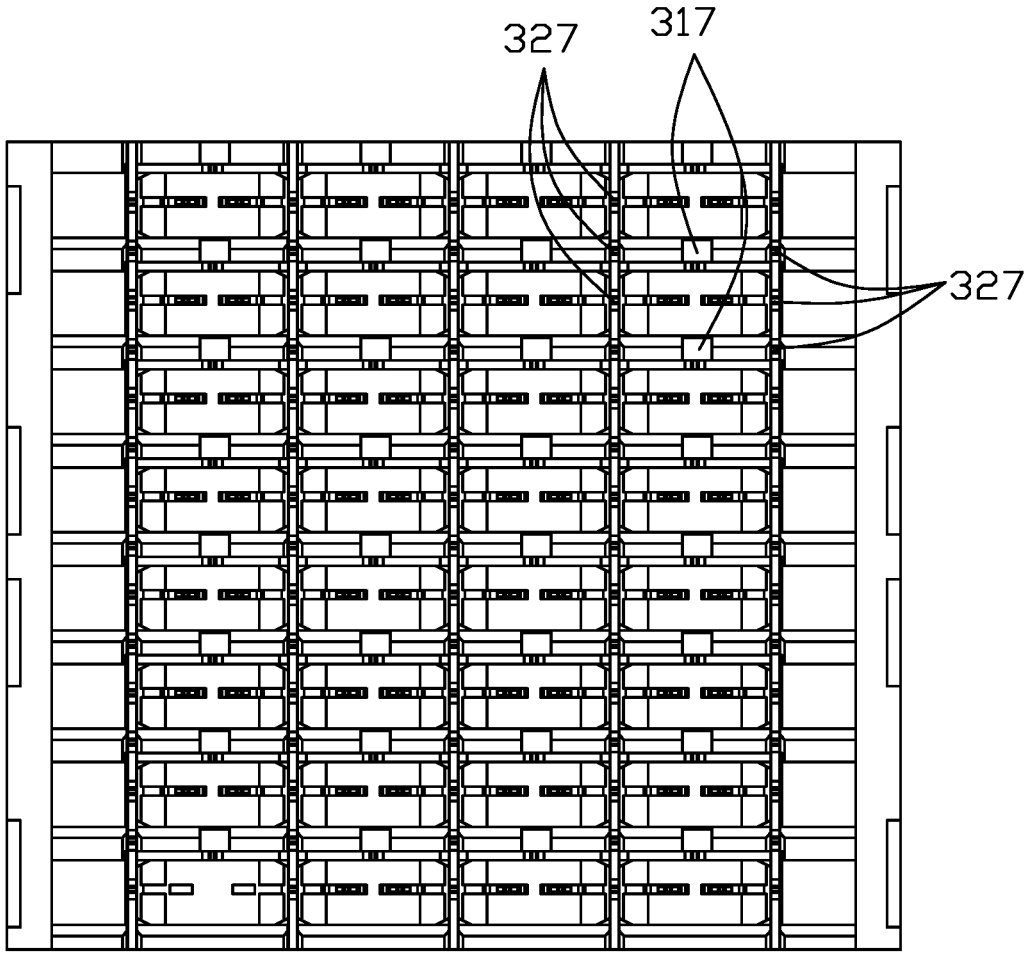
FIG. 7 is a top view of the first electrical connector in FIG. 1.
Figure 8:
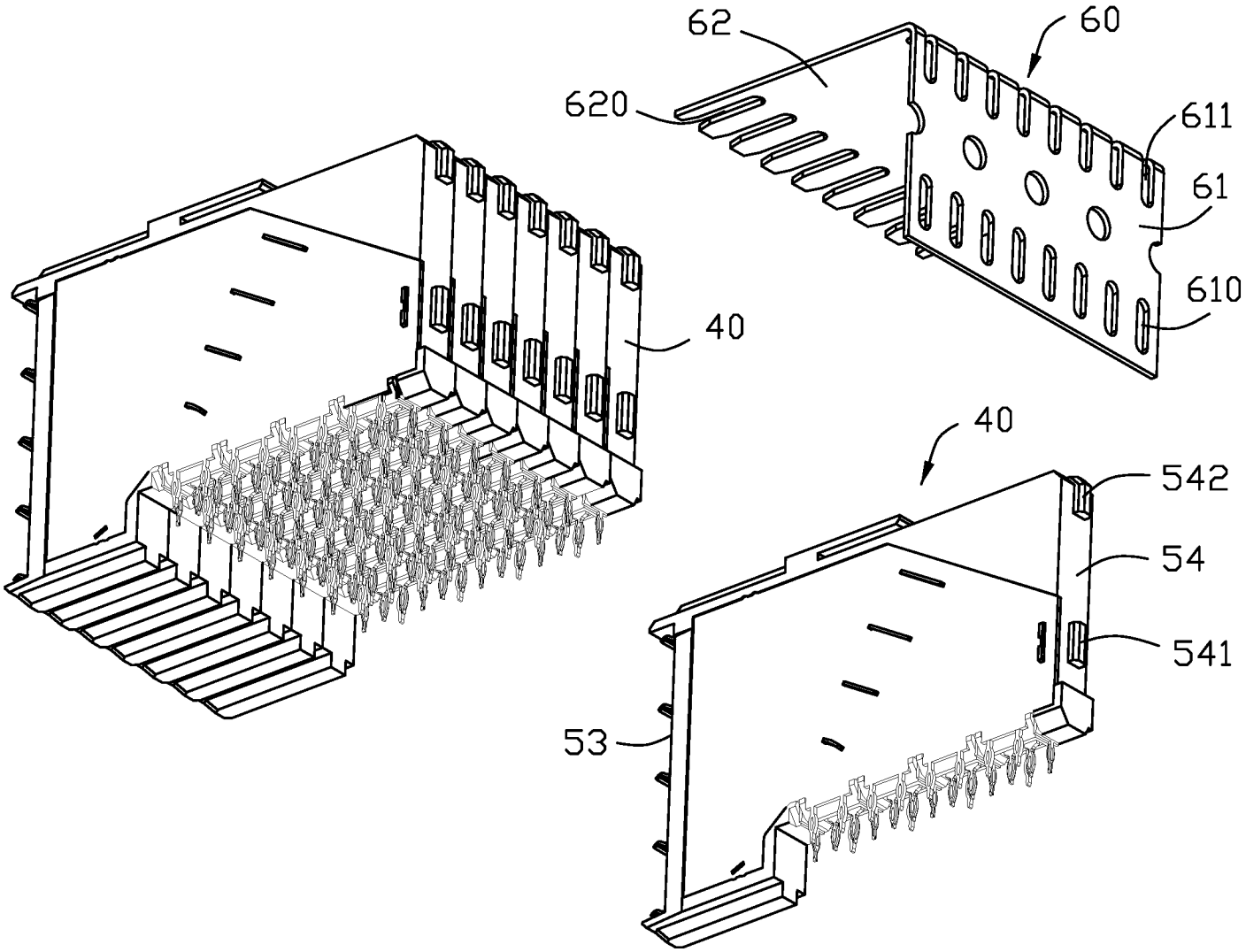
FIG. 8 is a partial exploded view of the second electrical connector in FIG. 1.
Figure 9:
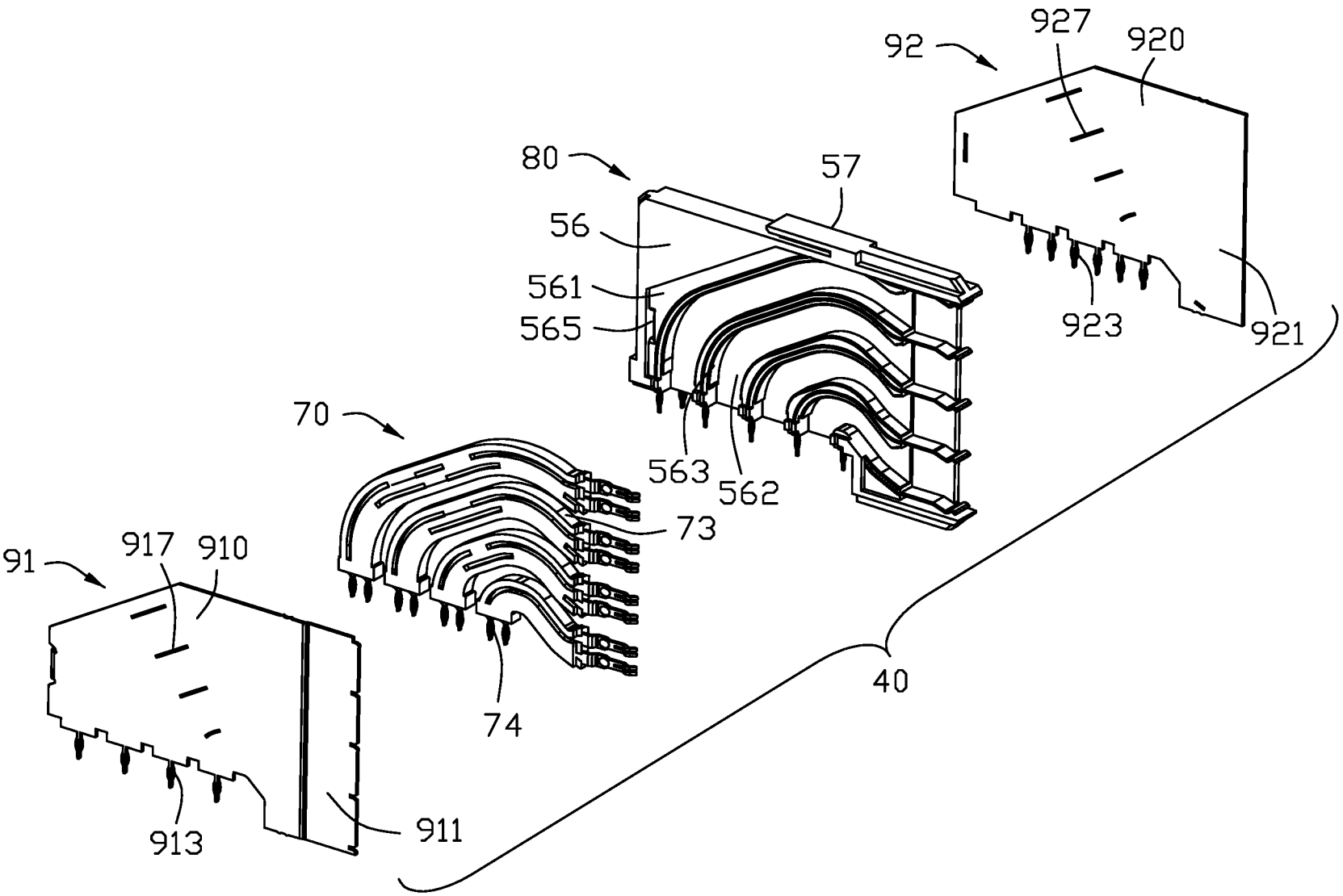
FIG. 9 is a partial exploded view of the terminal module of the second electrical connector in FIG. 8.
Figure 10:
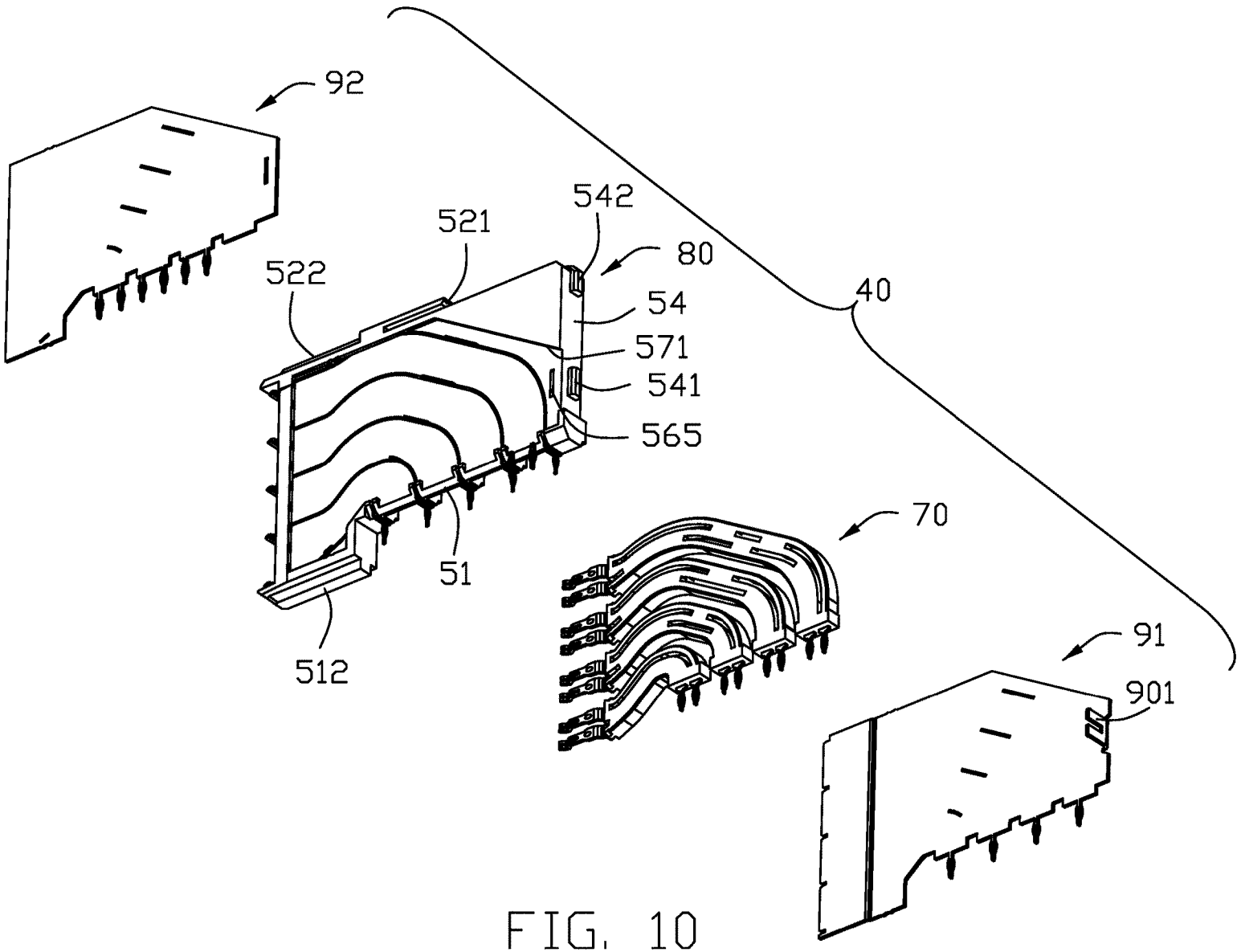
FIG. 10 is another partial exploded view of terminal module in FIG. 9.
Figure 11:
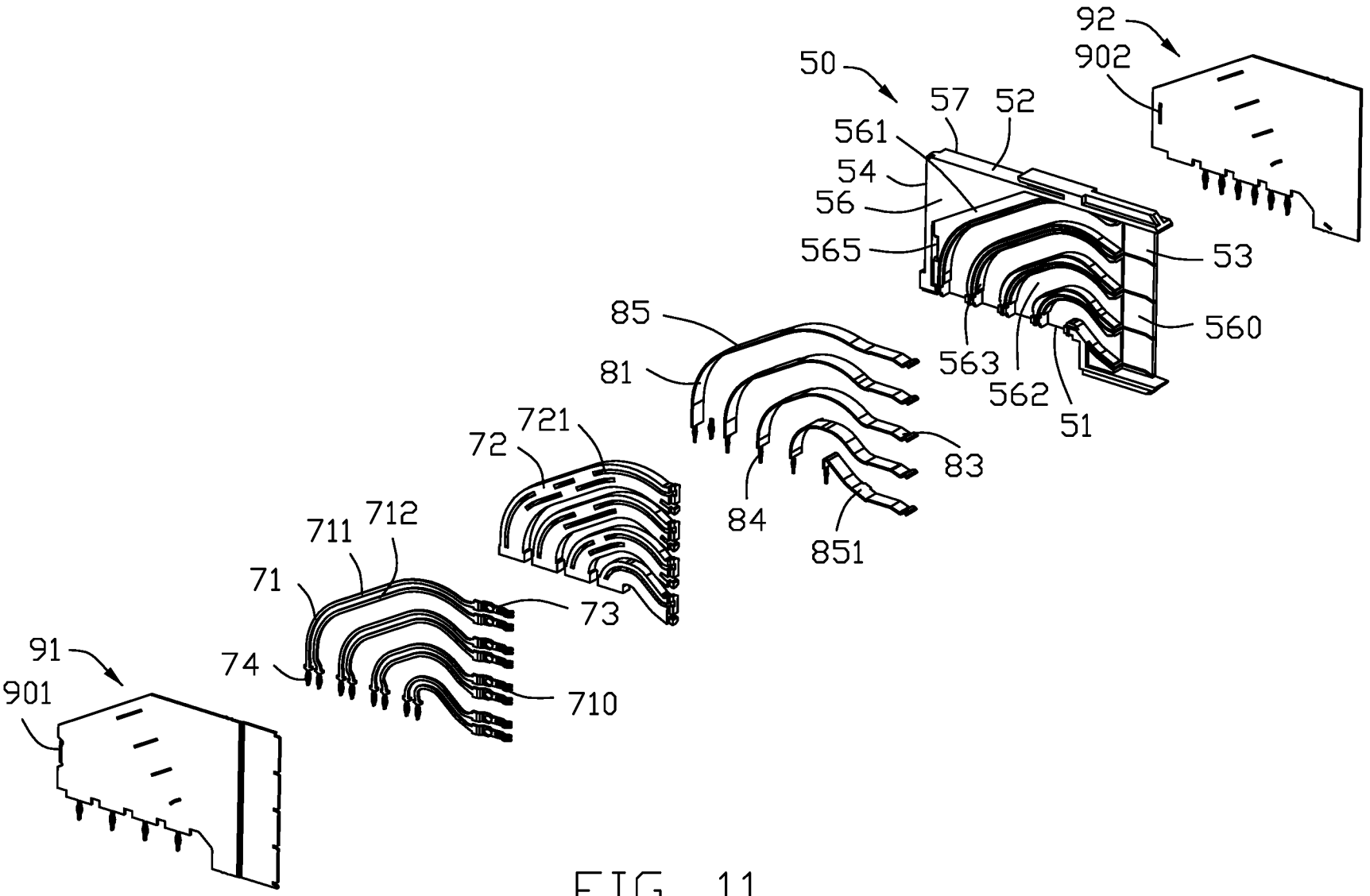
FIG. 11 is a further exploded view of the terminal module in FIG. 9.
Figure 12:
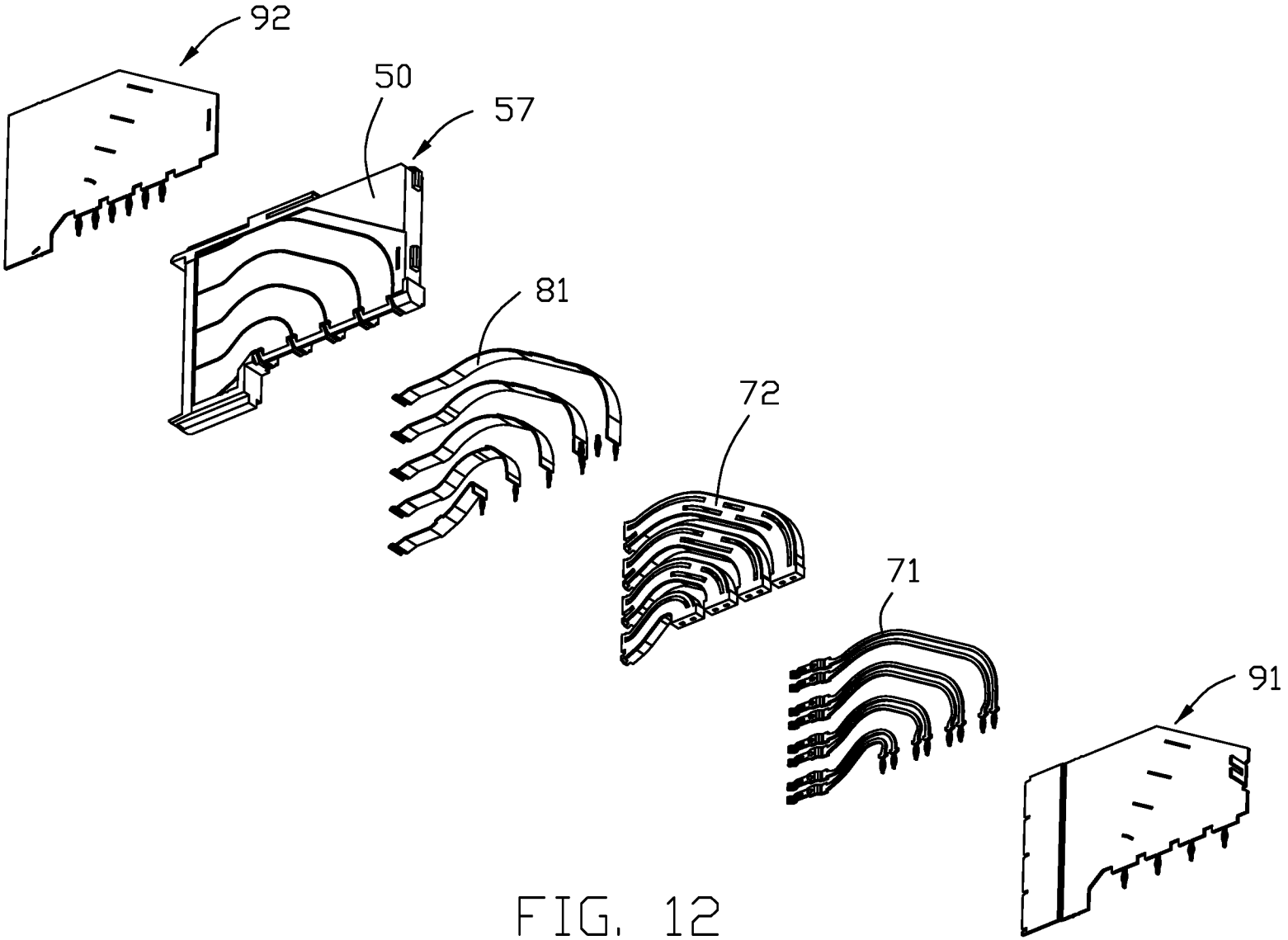
FIG. 12 is another view of the terminal module in FIG. 11.
Figure 13:
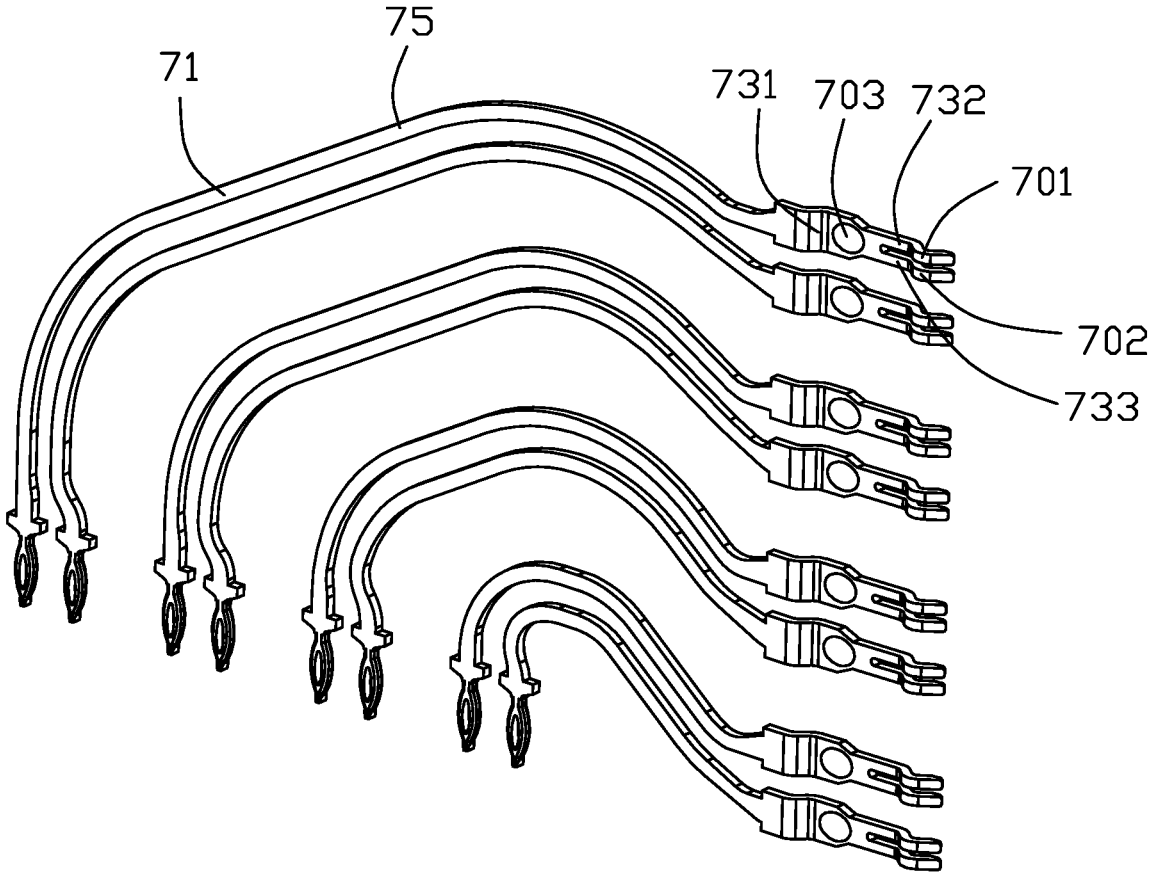
FIG. 13 is a perspective view of the signal terminal of the terminal module in FIG. 12.
Figure 14:
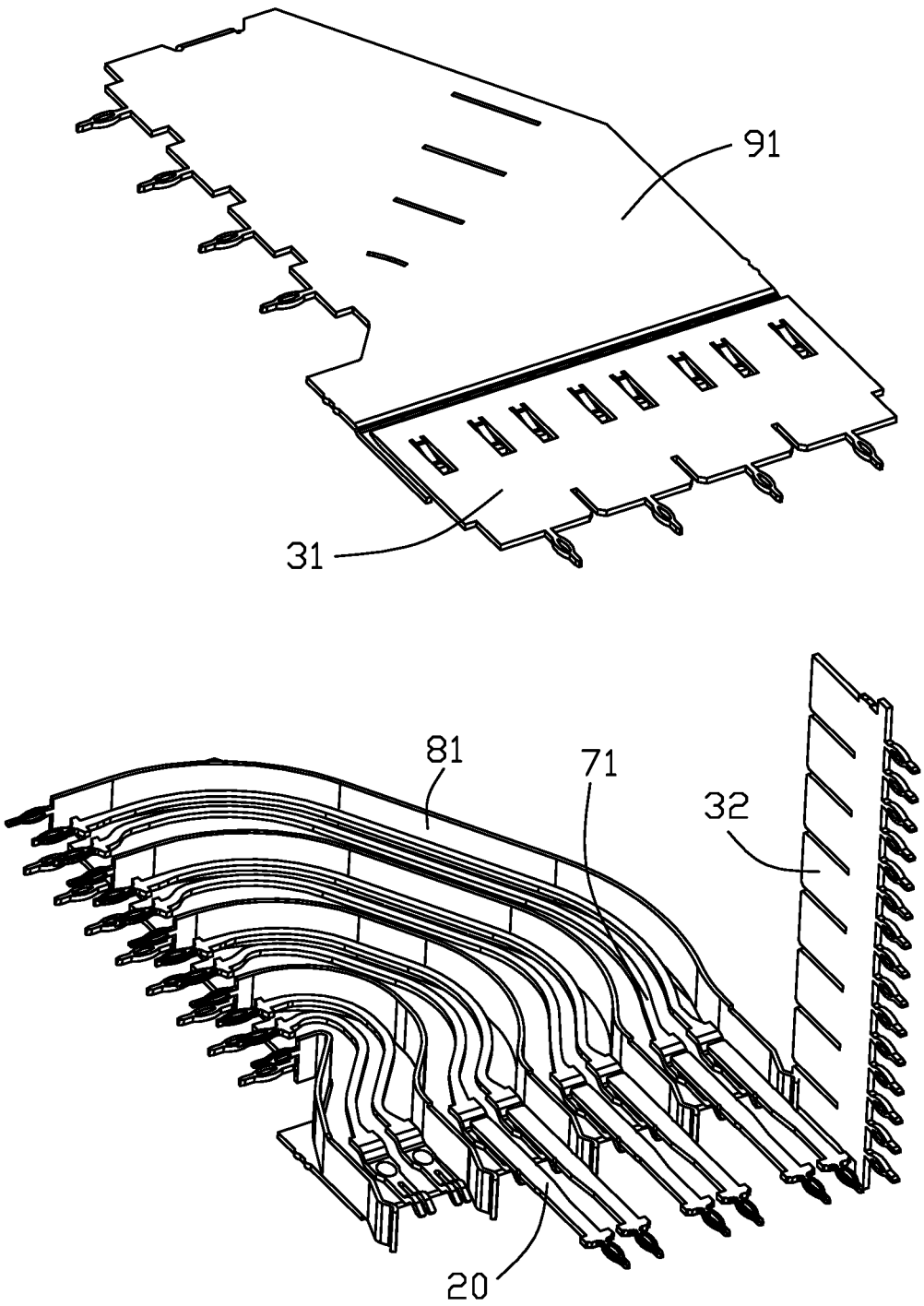
FIG. 14 is a perspective view of mutual cooperation between partial of the signal terminals and partial of the ground shield of the connector assembly in FIG. 1.
Figure 15:
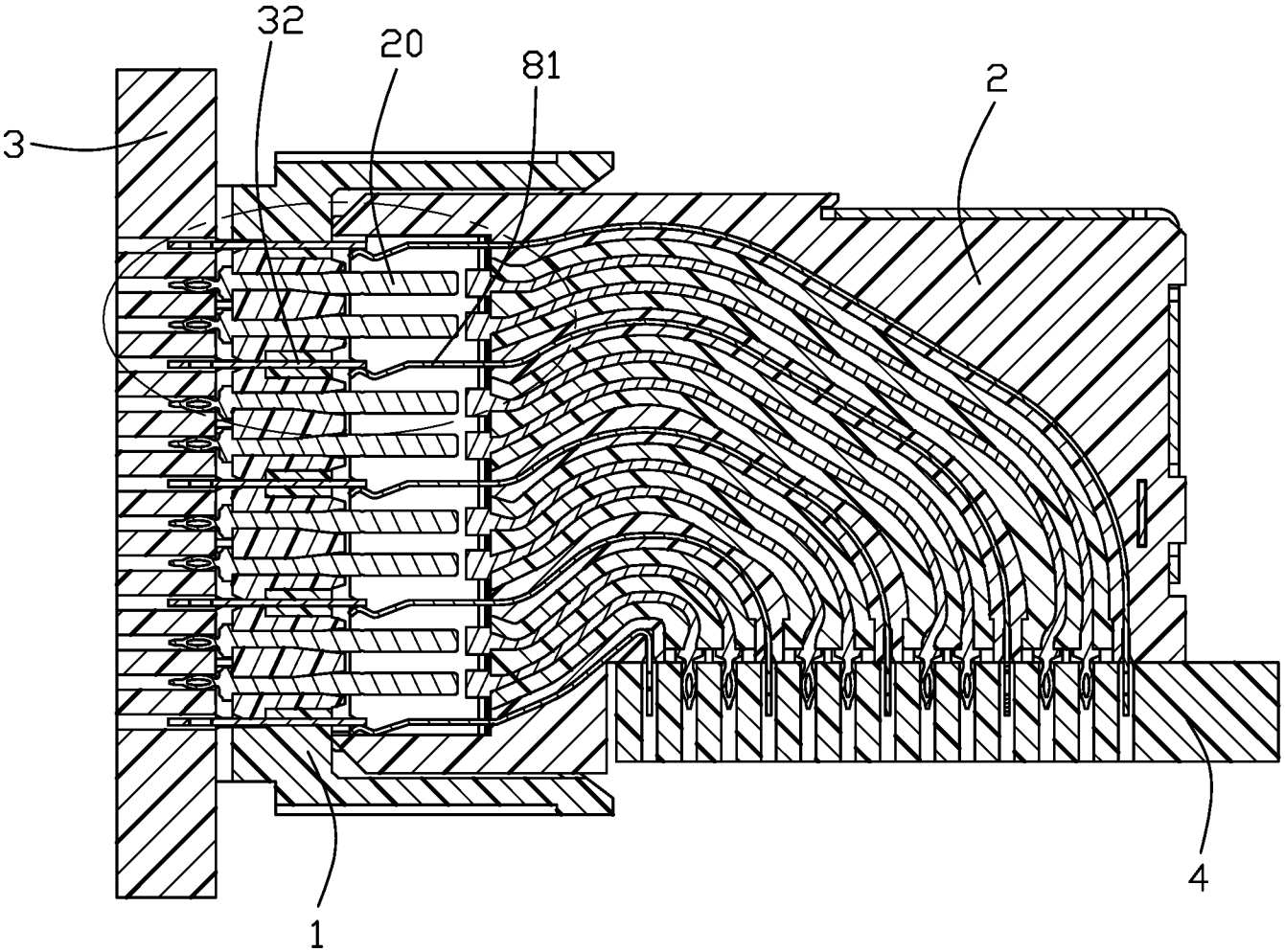
FIG. 15 is a cross-sectional view along line 15-15 of the connector assembly in FIG. 1.
Figure 16:
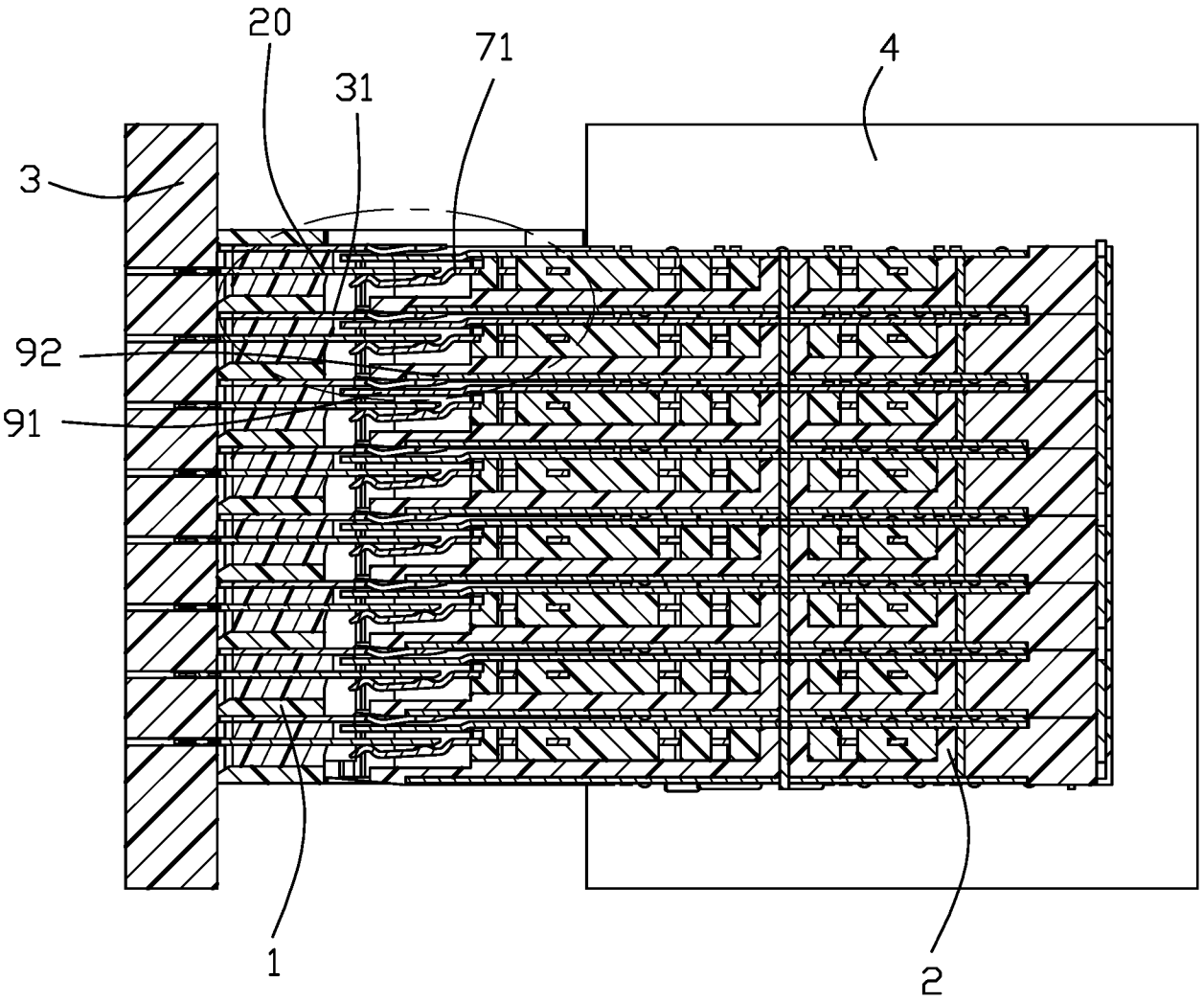
FIG. 16 is a cross-sectional view along line 16-16 of the connector assembly in FIG. 1.
Figure 17:
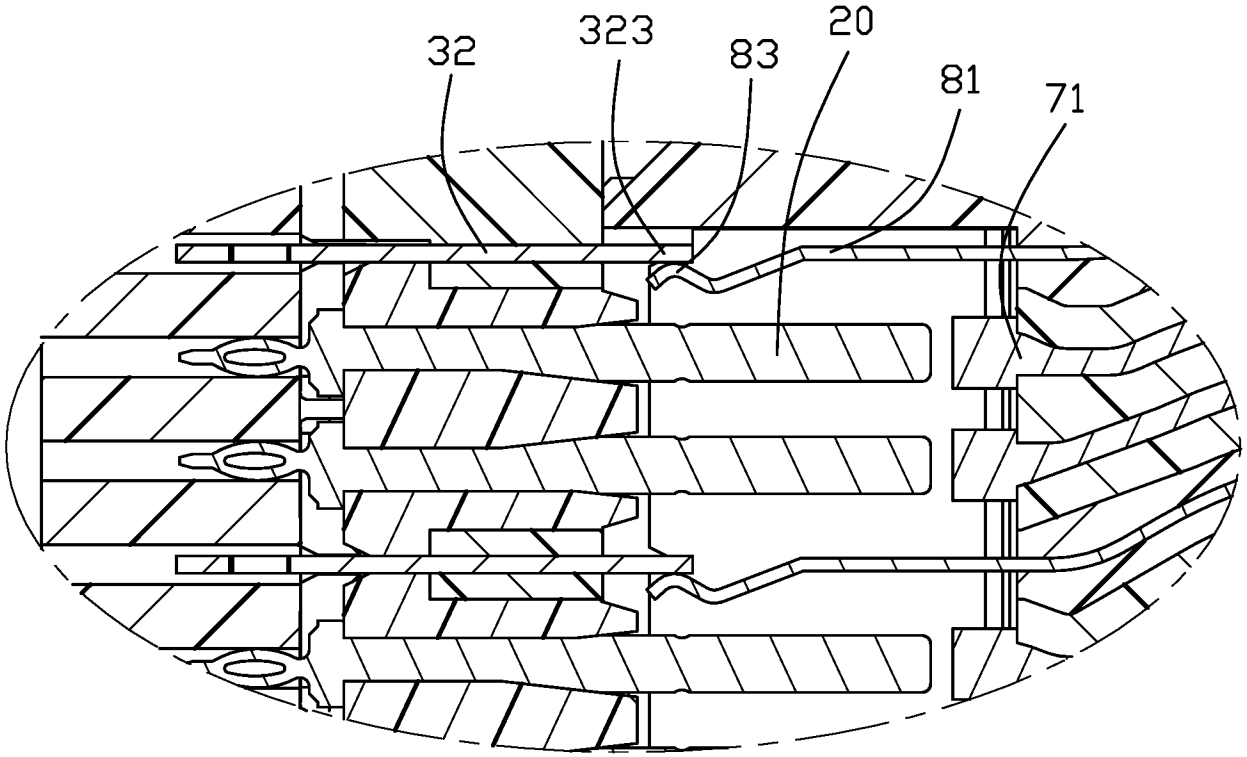
FIG. 17 is a partial enlarged view of connector assembly in FIG. 16.
Figure 18:
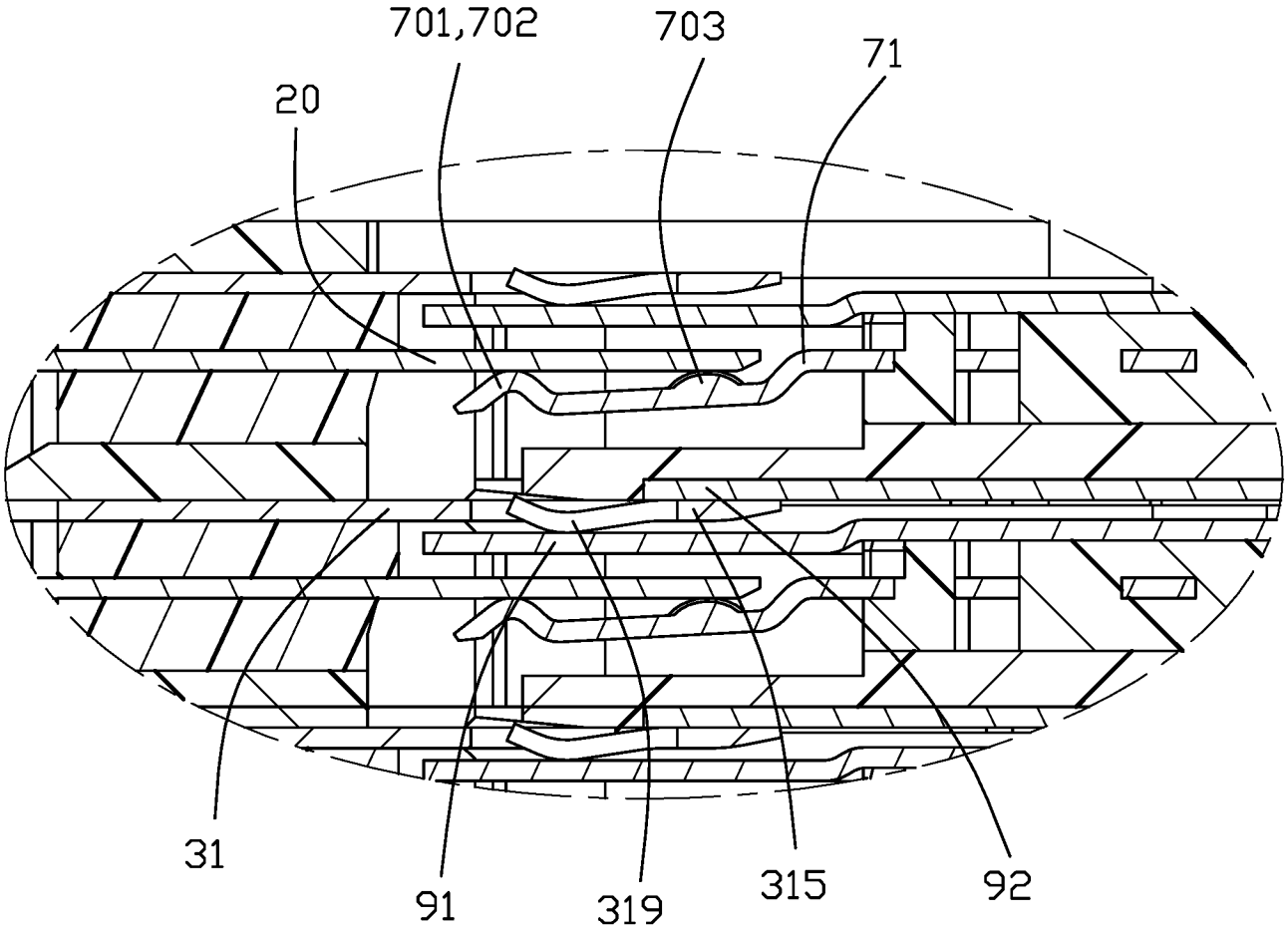
FIG. 18 is a partial enlarged view of connector assembly in FIG. 16.

Referring to FIGS. 1-17, The electrical connector assembly 100 of the present invention includes a first electrical connector 1 and a second electrical connector 2 that cooperates with the first electrical connector 1. The first electrical connector 1 is mounted on the first circuit board 3, and the second electrical connector 2 is mounted on the second circuit board 4, After the first electrical connector 1 and the second electrical connector 2 are mated, the transmission speed per channel can reach 112 Gbps, or even higher.

The first electrical connector 1 includes an insulating housing 10, a plurality of straight terminals 20 fixed on the insulating housing 10, a plurality of first grounding sheets 31 held on the insulating housing 10, the plurality of first ground sheets 31 are arranged at intervals in the lateral direction, a plurality of second grounding sheets 32 held on the insulating housing 10, the plurality of second grounding sheets 32 are arranged at intervals in the longitudinal direction. The plurality of first grounding sheets 31 and the plurality of second grounding sheets 32 cross each other to form a plurality of shielding cavities 33 separated from each other. The straight terminals 20 are distributed in the corresponding shielding cavity 33.

The insulating housing 10 includes a bottom wall 11 and a pair of side walls 12 spaced apart from each other extending from the same side of the bottom wall 11. The bottom wall 11 and the two side walls 12 jointly enclose a receiving space 13. The bottom wall 11 includes a plurality of mounting holes 111 arranged in rows and columns and penetrating the bottom wall 11 for mounting the straight terminals 20, and a plurality of installation gaps 112 for installing the second grounding sheet 32. The side wall 12 is provided with guide grooves 121 for guiding the second electrical connector 2 to be accurately inserted into the receiving space 13.

The straight terminals 20 are installed on the bottom wall 11 of the insulating housing 10 in several rows and several columns. The straight terminal 20 is used for transmitting signal, and is configured as a terminal pair for transmitting a pair of differential signals. Each pair of the straight terminals 20 is located in a corresponding shielding cavity 33. Each of the straight terminals 20 includes a holding portion 210 for mounting on the bottom wall 11, a mounting portion 211 extending downward from the holding portion 210 for mounting on the first circuit board 3, and a mating portion 213 extending upward from the holding portion 210 into the receiving space 13. It further includes a fixing block 22 integrally formed on the holding portion 210 of the pair of straight terminals 20. The mounting hole 111 on the bottom wall 11 cooperates with the fixing block 22 to fix a pair of straight terminals 20 on the bottom wall 11. Of course, the straight terminal 20 can be directly installed on the bottom wall 11 without the fixing block 22.

The plurality of the first grounding sheets 31 are parallel to each other, and the plurality of the second shielding sheets 32 are parallel to each other. The plurality of first grounding sheets 31 are integrally formed with the insulating housing 10, and the plurality of second grounding sheets 32 are assembled in the insulating housing 10. In this embodiment, the plurality of the first shielding sheets 31 and the plurality of the second shielding sheets 32 are perpendicular to each other. Each of the first grounding sheets 31 includes a first holding portion 310 held on the bottom wall 11, a first mounting portion 311 extending downward from the first holding portion 310 for connection with the first circuit board 3, and a first mating portion 313 extending upward from the first holding portion 310 into the receiving space 13. The first mating portion 313 includes a flat portion 315 and a plurality of elastic contact fingers 319 extending from the flat portion 315. The elastic contact finger 319 is integrally formed by stamping from the flat portion 315 and bent out of the plane where the flat portion 315 is located. Each of the second grounding sheet 32 includes a second holding portion 320 mounted on the bottom wall 11; a second mounting portion 321 extending downward from the second holding portion 320 for mounting on the first circuit board 3 and a second mating portion 323 extending upward from the second holding portion 320 into the receiving space 13. The first mating portion 313 extending into the receiving space 13 is larger than the mating portion 213 of the straight terminal 20 extending into the receiving space 13. The second mating portion 323 extending into the receiving space 13 is smaller than the mating portion 213 of the straight terminal 20 entering the receiving space 13. The first mounting portion 311 includes a plurality of first ground pins 317, the second mounting portion 321 includes a plurality of second ground pins 327. The number of the second ground pins 327 is at least three times the number of the first ground pins 317. After the first electrical connector 1 is assembled, a first ground pin 317 is provided on each side of the mounting portion 211 of the pair of straight terminals 20 in the transverse direction, a plurality of second ground pins 327 are provided on both sides of the longitudinal direction. The first holding portion 310 is provided with a plurality of first grooves 318 with downward openings, and the second mating portion 323 is provided with a plurality of second grooves 328 with upward openings. The first grounding sheets 31 and the second grounding sheet 32 are engaged with each other through the first groove 318 and the second grooves 328. Both sides of the second holding portion 320 of the second grounding sheet 32 are respectively provided with abutting portions 329. The abutting portion 329 is used to limit the position of the insulating housing 10 when the second grounding sheet 32 is installed from bottom to top, so as to ensure that the second grounding sheets 32 inserted into the bottom wall 11 are installed at predetermined positions.

The straight terminal 20 for signal transmission of the first electrical connector 1 is shielded by the first grounding sheets 31 and the second grounding sheet 32 in a circumferential direction, which improves the shielding effect of the first electrical connector 1. In addition, the first grounding sheet 31 and the insulating housing 10 are integrally formed, and the second grounding sheet 32 is assembled into the insulating housing 10, so that the structure of the insulating housing 10 is simple and reliable, and provides better conditions for stable transmission of high-frequency signals.

The second electrical connector 2 includes a plurality of terminal modules 40 laterally stacked and a holder 60 for fixing the plurality of terminal modules 40 together. Each terminal module 40 includes an insulating body, a plurality of signal terminals 71 held in the insulating body, a plurality of ground terminals 81 held in the insulating body, a first ground plate 91 and a second ground plate 92 located on opposite sides of the terminal module 40.

The insulating body includes a plurality of first insulating bodies 72 for holding signal terminals 71 and a second insulating body 50 for holding ground terminals 81. Each first insulating body 72 holds a pair of signal terminals 71 to form a signal terminal assembly 70. Each second insulating body 50 holds a plurality of ground terminals 81 to form a ground terminal assembly 80. A pair of signal terminals 71 is integrally formed in one of the first insulating body 72. A plurality of ground terminals 81 are integrally formed in the second insulating body 50.

The signal terminal 71 is arranged in the form of a signal terminal pair 710 for transmitting a pair of differential signals. In one terminal module 40, the differential signal terminal pair 710 and the ground terminal 81 are arranged at intervals in the vertical direction, each of the signal terminals 71 includes a wide side and a narrow side, and each of the ground terminals 81 includes a wide side and a narrow side. The size of the broad side of the ground terminal 81 is larger than the size of the broad side of the signal terminal 71. The broad sides of the signal terminal pairs 710 are arranged in the same plane. The broad side of each ground terminal 81 is arranged in a plane intersecting the plane where the differential signal terminal pair 710 is located. Preferably, in this embodiment, each ground terminal 81 is arranged in a plane perpendicular to the plane where the differential signal terminal pair 710 is located.

Each of the signal terminals 71 includes a mating end 73 extending in the mating direction, a mounting end 74 extending in the mounting direction, and an intermediate portion 75 between the mounting end 74 and the mating end 73. The mating end 73 is perpendicular to the mounting end 74. The two signal terminals 71 constituting the signal terminal pair 710 are narrow-side coupled from the mounting end 74 to the mating end 73. The mating end 73 includes a body 731 and a pair of beams extending from the body 731 to the mating direction. The first beam 732 includes a first contact portion, the second beam 733 includes a second contact portion, and the body 731 includes a third contact portion. The first contact portion includes a first contact protrusion 701, the second contact portion includes a second contact protrusion 702, and the third contact portion includes a third contact protrusion 703. The first contact protrusion 701 and the second contact protrusion 702 are arranged along a first direction. The third contact protrusion 703 is arranged in a direction perpendicular to the first direction and opposite to the mating direction. When the second electrical connector 2 is mated with the first electrical connector 1, The mating connector 1 first mate with the first contact protrusion 701 and the second contact protrusion 702, and then with the third contact protrusion 703. The area of the third contact protrusion 703 is larger than the sum of the areas of the first contact protrusion 701 and the second contact protrusion 702. The protrusion heights of the first contact protrusion 701 and the second contact protrusion 702 are the same. The protrusion height of the third contact protrusion 703 is smaller than the height of the first contact protrusion 701. The first contact protrusion 701 and the second contact protrusion 702 are formed by bending the first beam 732 and the second beam 733 in a third direction perpendicular to the first direction and perpendicular to the second direction. The third contact protrusion 703 is stamped from the body 731. The first contact protrusion 701, the second contact protrusion 702, and the third contact protrusion 703 all protrude in the third direction. The first contact protrusion 701 and the second contact protrusion 702 protrude along the entire first direction of the first beam 732 and the second beam 733. The first contact protrusion 701 and the second contact protrusion 702 extend along the entire first direction of the first beam 732 and the second beam 733. The periphery of the third contact protrusion 703 is enclosed in the body 731. When the signal terminal 71 is mated with the straight terminal 20 of the first electrical connector 1, the three contact protrusion are all in contact with the straight terminal 20, so that there are two contact points along the mating direction. Two contacts are relative to one contact, which effectively solves the impact of the capacitive effect of single-point contact on impedance matching during high-speed signal transmission, improved impedance matching of connector assembly after interconnection and improved insertion loss.

Each pair of the signal terminals 71 includes a first signal terminal 711 and a second signal terminal 712. The length of the first signal terminal 711 is greater than the length of the second signal terminal 712. In this embodiment, the first insulating body 72 is provided with air gaps 721 for exposing the first signal terminal 711 and the second signal terminal 712 to the air. The air gap 721 can be continuous or discontinuous. The length of the first signal terminal 711 exposed in the air gap 721 is greater than the length of the second signal terminal 712 exposed in the air gap 721. The air gap 721 can be provided only on one side of the first insulating body 72, or can be provided on both sides of the first insulating body 72.

The second insulating body 50 has a sheet structure, it includes a lower edge 51 disposed toward the second circuit board, an upper edge 52 opposite to the lower edge 51, and a front edge 53 and a rear edge 54 connecting the upper edge 52 and the lower edge 51, The upper edge 52 is provided with a holding rib 521, and the rear edge 54 is provided with a holding rib 541 and a holding rib 542. The holder 60 includes a rear wall 601 extending and fitting along the rear edge 54 of the second insulating body 50, and an upper wall 602 extending and fitting along the upper edge 52. The rear wall 601 is provided with a holding groove 610 for receiving the corresponding holding rib 541 and a holding groove 611 for receiving the corresponding holding rib 542. The retaining groove 611 may extend from the rear wall 601 to the upper wall 602 or may only be provided on the rear wall 601. The upper wall 602 is provided with a retaining groove 620 for receiving the retaining rib 521 of the upper edge 52. The terminal modules 40 can be fixed together by the holder 60 to achieve alignment in the lateral direction. The second insulating body 50 is also provided with a edge 512 and edge 522 on the lower edge 51 and the upper edge 52, respectively, the edge 512 and the edge 522 are used to guide the second electrical connector 2 to be aligned with the guide groove 121 on the first electrical connector 1.

The second insulating body 50 has a first side 56 and a second side 57 opposite to each other in the thickness direction. The first side 56 is provided with mounting grooves 560 and a plurality of grooves 562 passing through the mounting groove 560. The mounting groove 560 is recessed from the front edge 53 and from the first side 56 into the second insulating body 50. The groove 562 is recessed from the first side surface 56 into the second insulating body 50 and extends from the mounting groove 560 to the lower edge 51. The groove 562 has a shape approximately the same as the length and width of the first insulating body 72. Each of the grooves 562 is used to receive the first insulating body 72 holding a pair of signal terminals 71. The second insulating body 50 includes protrusions 563 on both sides of each groove 562, and each ground terminal 81 is located in a corresponding protrusion 563. In the vertical direction, ground terminals 81 are provided on both sides of each of a differential signal terminal pairs 710. The ground terminal 81 includes a ground mating end 83 that cooperates with the first electrical connector 1, a ground mounting end 84 mounted on the second circuit board, and a ground intermediate region 85 between the ground mounting end 84 and the ground mating end 83. The ground mounting end 84 extends beyond the mounting end 74 of the signal terminal 71. The ground mating end 83 extends beyond the mating end 73 of the signal terminal 71 along the mating direction, so that the signal terminals are shielded on the entire transmission path. The width dimension of the ground intermediate region 85 of the ground terminal 81 is larger than the dimension from the second side to the first side of the second insulating body 50. The ground intermediate region 85 is exposed from both sides of the second insulator 50. The ground intermediate region 85 includes contact pieces 851 that further extend to corresponding sides. The mating end 73 of the signal terminal 71 and the ground mating end 83 of the grounding terminal are received in the mounting groove 560 in the form of a cantilever beam for mating with the straight terminal 20 on the first electrical connector 1.

The first ground plate 91 is arranged on the first side 56 of the second insulating body 50, and the second ground plate 92 is arranged on the second side 57 opposite to the first side 56. The second insulating body 50 is provided with a first mounting frame 561 for mounting the first ground plate 91 and a second mounting frame 571 for mounting the second ground plate 92. The first mounting frame 561 has the same contour as the first ground plate 91, and the second mounting frame 571 has the same contour as the second ground plate 92. The first mounting frame 561 is recessed from the first side 56 of the second insulating body 50 toward the second insulating body 50. The second mounting frame 571 is recessed from the second side 57 of the second insulating body 50 toward the second insulating body 50. The thickness of the first ground plate 91 is not greater than the depth of the first mounting frame 561, and the thickness of the second ground plate 92 is not greater than the depth of the second mounting frame 571. Preferably, the depth of the first mounting frame 561 is the same as the depth of the first ground plate 91, and the depth of the second mounting frame 571 is the same as the thickness of the second ground plate 92. In this embodiment, after the first ground plate 91 and the second ground plate 92 are installed on the second insulating body 50. Each terminal module 40 has the same thickness, which is the same as the thickness of the second insulating body 50. A hole 565 is also provided in the first mounting frame 561. The hole 565 penetrates the first side 56 and the second side 57 of the second insulating body 50, and is usually slit-shaped. A slit 902 is provided on the second ground plate 92. The first ground plate 91 includes a contact blade 901. The contact blade 901 extends through the hole 565 and is matched with the slit 902 to mechanically and electrically connect the first ground plate 91 and the second ground plate 92.

The first ground plate 91 includes a first flat portion 910, a first contact portion 911 extending from the first flat portion 910 in the mating direction, and a first mounting foot 913 extending from the first flat portion 910 toward the circuit board. The second ground plate 92 includes a second flat portion 920, a second contact portion 921 extending from the second flat portion 920 in the mating direction, and a second mounting foot 923 extending from the second flat portion 920 toward the circuit board. The length of the first contact portion 911 extending in the mating direction is greater than the length of the second contact portion 921 extending in the mating direction. The first contact portion 911 is closer to the second insulating body 50 than the first flat portion 910, the second contact portion 921 and the second flat portion 920 are in the same plane. So the first contact part 911 is also closer to the second contact part 921. When the terminal module 40 is assembled together, the distance between the first contact portion 911 and the second contact portion 921 of the adjacent first ground plate 91 and the second ground plate 92 of the two adjacent terminal modules 40 is greater than the distance between the first flat portion 910 and the second flat portion 920, so that the first mating portion 313 of the first grounding sheet 31 of the first electrical connector 1 can extend between the first contact portion 911 and the second contact portion 921, and is mechanically and electrically connected to the first contact portion 911 and the second contact portion 921. The flat portion 315 of the first mating portion 313 is in contact with the second contact portion 921, and the elastic contact finger 319 is in contact with the first contact portion 911. The first flat portion 910 includes a first aperture 917 that can be matched with the contact piece 851 of the ground terminal 81, the second flat portion 920 includes a plurality of second apertures 927 that can be matched with the contact pieces 851 on the second side of the ground terminal 81. The ground terminal 81 cooperates with the first ground plate 91 and the second ground plate 92 to form a circumferential shielding channel. The pair of signal terminals 71 located in the channel are completely shielded in the circumferential direction on the entire transmission path. The crosstalk effect of a pair of signal terminals 71 will be reduced to an ideal state, in order to achieve the purpose of reducing signal crosstalk between each pair of signal terminals, and a higher rate of signal transmission can be achieved.

When the first electrical connector 1 and the second electrical connector 2 are mated, each pair of straight terminals 20 and the corresponding signal terminal 71 cooperate with each other to form a pair of signal paths. The first grounding sheet 31 is mechanically connected to the adjacent first ground plate 91 and the second ground plate 92 of two adjacent terminal modules. The second grounding sheet 32 and the ground terminal 81 cooperate with each other to completely shield the straight terminal 20 and the signal terminal 71 in the circumferential direction on the entire transmission path, has a good shielding effect of the electromagnetic crosstalk and the structure is simple and reliable, which provides good conditions for the stable transmission of high-frequency signals.

The above are only one embodiments of the present invention, but not the only embodiments. Any equivalent changes to the technical solutions of the present invention by those skilled in the art by reading the description of the present invention are covered by the claims of the present invention.

What is claimed is:

1. An electrical connector comprising:

a plurality of terminal modules stacked laterally, each of the terminal modules including:

an insulating body;

plural pairs of signal terminals held by the insulating body;

a plurality of ground terminals held by the insulating body; and a first ground plate and a second ground plate located on opposite sides of the insulating body, wherein in each terminal module, the ground terminals and the pairs of signal terminals are alternately arranged in a vertical direction, each pair of signal terminals are arranged in a first plane, each ground terminal is arranged in a second plane intersecting the first plane, the first ground plate, the second ground plate, and the ground terminals shield each pair of signal terminals circumferentially.

2. The electrical connector as claimed in claim 1, wherein the first ground plate and the second ground plate of each terminal module are mechanically and electrically connected.

3. The electrical connector as claimed in claim 2, wherein the first grounding plate is provided with a contact blade, and the second contact plate is provided with a slit mated with the contact blade.

4. The electrical connector as claimed in claim 3, wherein at least one of the first ground plate and the second ground plate is mechanically and electrically connected to the ground terminal.

5. The electrical connector as claimed in claim 4, wherein at least one of the first ground plate and the second ground plate includes a mounting hole, and the ground terminal includes a contact piece extending from the insulating body and matching with the mounting hole.

6. The electrical connector as claimed in claim 1, wherein the insulating body includes a first insulating body holding the signal terminals and a second insulating body holding the ground terminals, a groove is provided between two adjacent ground terminals on one side of the second insulating body, and the first insulating body is assembled and housed in the groove.

7. The electrical connector as claimed in claim 6, wherein the signal terminal and the first insulating body are integrally formed, and the ground terminal and the second insulating body are integrally formed.

8. The electrical connector as claimed in claim 1, wherein each of the first ground plate and the second ground plate includes a flat plate portion and a contact portion extending from the flat plate portion, in each terminal module the contact portion of at least one of the first ground plate and the second ground plate is closer than the flat plate portion thereof to the other ground plate so that a distance between the contact portions of adjacent ground plates of two adjacent terminal modules is greater than a distance between the flat plate portions thereof.

9. The electrical connector as claimed in claim 6, wherein the ground terminal includes a ground mounting end, a ground mating end, and an intermediate region between the ground mating end and the ground mounting end, a width of the ground terminal is greater than a width of the second insulating body to expose the intermediate region of the ground terminal from a corresponding side of the second insulating body.

10. The electrical connector as claimed in claim 1, wherein each signal terminal includes a mating end, a mounting end, and an intermediate portion between the mounting end and the mating end, the mating end includes a first contact portion, a second contact portion, and a third contact portion, the first contact portion and the second contact portion are arranged along a first direction, and the third contact portion is arranged in a second direction perpendicular to the first direction.

11. The electrical connector as claimed in claim 10, wherein the third contact portion is arranged in a direction opposite to a mating direction relative to the first contact portion and the second contact portion.

12. The electrical connector as claimed in claim 11, wherein the first contact portion includes a first contact protrusion, the second contact portion includes a second contact protrusion, and the third contact portion includes a third contact protrusion, the mating end includes a body and a pair of beams extending from the body in the mating direction, the first contact protrusion is located on one of the pair of beams, the second contact protrusion is located on the other of the pair of beams, and the third contact protrusion is located on the body.

13. An electrical connector assembly comprising:

an electrical connector comprising a plurality of first ground sheets arranged laterally; and a mating connector cooperating with the electrical connector and comprising a plurality of terminal modules laterally arranged, each terminal module including a first ground plate on a first side of the terminal module and a second ground plate on an opposite second side of the terminal module, wherein the first ground sheet is mechanically and electrically connected to the first ground plate and the second ground plate at adjacent sides of two adjacent terminal modules.

14. The electrical connector assembly as claimed in claim 13, wherein after the electrical connector and the mating connector are mated with each other, the first ground sheet is located between the first ground plate and the second ground plate on adjacent sides of two adjacent terminal modules.

15. The electrical connector assembly as claimed in claim 14, wherein the first ground plate includes a first flat portion and a first contact portion extending from the first flat plate portion, the second ground plate includes a second flat portion and a second contact portion extending from the second flat portion, and the first contact portion is closer to the second ground plate than the second contact portion.

16. The electrical connector assembly as claimed in claim 15, wherein a length of the first contact portion extending in the mating direction is greater than a length of the second contact portion extending in the mating direction.

17. The electrical connector assembly as claimed in claim 16, wherein the first ground sheet includes a first mating portion, the first mating portion includes a flat portion and a plurality of elastic contact fingers protruding from the flat portion, the flat plate portion is in contact with the second contact portion on adjacent sides of two adjacent terminal modules, the elastic contact fingers are in contact with the first contact portions on adjacent sides of two adjacent terminal modules.

18. The electrical connector assembly as claimed in claim 14, wherein the terminal module includes an insulating body and plural signal and ground terminals fixed in the insulating body and arranged alternately in a vertical direction, the signal terminals are arranged in a first plane, and each of the ground terminals is located in a respective second plane perpendicular to the first plane.

19. The electrical connector assembly as claimed in claim 18, further including an insulating housing, a plurality of signal terminals held in the insulating housing, and a plurality of second grounding sheets held in the insulating housing, the first ground sheet and the second ground sheet are perpendicular to each other, the first ground plate and the second ground plate shield the signal terminal from a circumferential direction, the second ground sheet is mechanically and electrically connected to the ground terminals of all terminal modules.

20. The electrical connector assembly as claimed in claim 19, wherein the first ground plate and the second ground plate of each terminal module are combined with the ground terminal to shield a pair of signal terminals from the circumferential direction.

* * * * *